United States Patent [19]

Hoskinson

[11] 4,253,369

[45] Mar. 3, 1981

[54] DIGITAL CONTROL OF ATTACK AND DECAY

[75] Inventor: William R. Hoskinson, Geneva, Ill.

[73] Assignee: The Wurlitzer Company, DeKalb, Ill.

[21] Appl. No.: 917,308

[22] Filed: Jun. 20, 1978

[51] Int. Cl.[3] ..... G10H 1/02

[52] U.S. Cl. ..... 84/1.26; 84/1.13

[58] Field of Search ..... 84/1.13, 1.24, 1.26; 307/223 R; 328/43

[56] References Cited

U.S. PATENT DOCUMENTS

| | | | |
|---|---|---|---|
| 3,665,091 | 5/1972 | Hirano | 84/1.26 |
| 3,746,775 | 7/1973 | Uchiyama | 84/1.26 |
| 3,935,783 | 2/1976 | Machanian et al. | 84/1.26 |
| 4,038,896 | 8/1977 | Faulkner | 84/1.01 |
| 4,067,253 | 1/1978 | Wheelwright | 84/1.13 |

OTHER PUBLICATIONS

Lancaster, "Keying and VCA Circuits," Popular Electronics, Feb. 1975, pp. 37–39 (see p. 38).

Lancaster, "Envelope Generators & Sequencers for Electronic Music," Popular Electronics, Jan. 1976, pp. 58–62 (see p. 61).

*Primary Examiner*—J. V. Truhe

*Assistant Examiner*—Forester W. Isen

*Attorney, Agent, or Firm*—Trexler, Wolters, Bushnell & Fosse, Ltd.

[57] ABSTRACT

In a digital electronic organ or the like external waves of controllable duty cycle are used to control the on time of a field effect transistor (FET) through which a capacitor is charged. A similar rectangular wave of controllable duty cycle is applied to a second FET to control the on time thereof for controlling the discharge of said capacitor. The state of charge of said capacitor is used to control the conductivity of yet another FET through which a desired frequency is conducted to effect enveloping of such frequency with the desired attack and decay characteristics.

3 Claims, 5 Drawing Figures

DIGITAL CONTROL OF ATTACK AND DECAY

BACKGROUND OF THE INVENTION

Up until rather recently substantially all electronic keyboard musical instruments, generally electronic organs, have been of an analog nature. Some such organs have used direct or ac keying in which a note to be played is simply conducted by a mechanical key switch. Such note is either on or off, i.e., there is no possibility of attack and decay. Other organs have utilized indirect or dc keying in which the mechanical key switch has applied a potential to a controllable conducting device, typically a semiconductor such as a diode or transistor, although vacuum tube devices were occasionally used in an earlier day. It is possible to control the conductivity of such a device by the voltage level applied thereto. Thus, rc timing circuits of an analog nature have readily been able to control attack and decay.

With recent advances in electronics, and particularly large scale integrated (LSI) circuit chips, efforts have been made toward producing electronic musical instruments utilizing digital techniques, due to the facility of handling digital signals in LSI circuits and the difficulty of handling analog signals in such circuits. This has presented problems as to developing attack and decay, since the great advantage of digital techniques with integrated circuits is that a signal is at all times either a one or a zero. Hence, the signal cannot be scaled in magnitude as heretofore has been the case with dc keying in conventional analog organ circuits.

OBJECTS AND BRIEF DISCLOSURE OF THE PRESENT INVENTION

It is a broad object of the present invention to provide means for controlling attack and decay in a digital organ.

It is another object of this invention to provide a circuit in which digital signals are used to determine rise and decay time envelopes for a pulse train.

It is a further object of this invention to provide an improved field effect transistor circuit for controlling rise and fall times of a waveform.

More particularly, the tone which is to be produced by closing of any key switch is represented by a digitally derived square wave of constant amplitude. This wave is applied to an input electrode or source of a control field effect transistor (FET). The conductivity of this control FET is controlled by the state of charge of an attack and decay capacitor. This capacitor is charged through a charging FET the on time of which is controlled by the duty cycle of an external digital attack wave of controllable duty cycle. Similarly, the discharge of said capacitor is controlled by a discharge FET the on time of which is controlled by an external rectangular digital wave of controllable duty cycle.

DESCRIPTION OF THE DRAWINGS

Objects and advantages of the present invention will be understood best with regard to the following description when taken in accompaniment with the drawings wherein.

DETAILED DESCRIPTION

Figure 1:
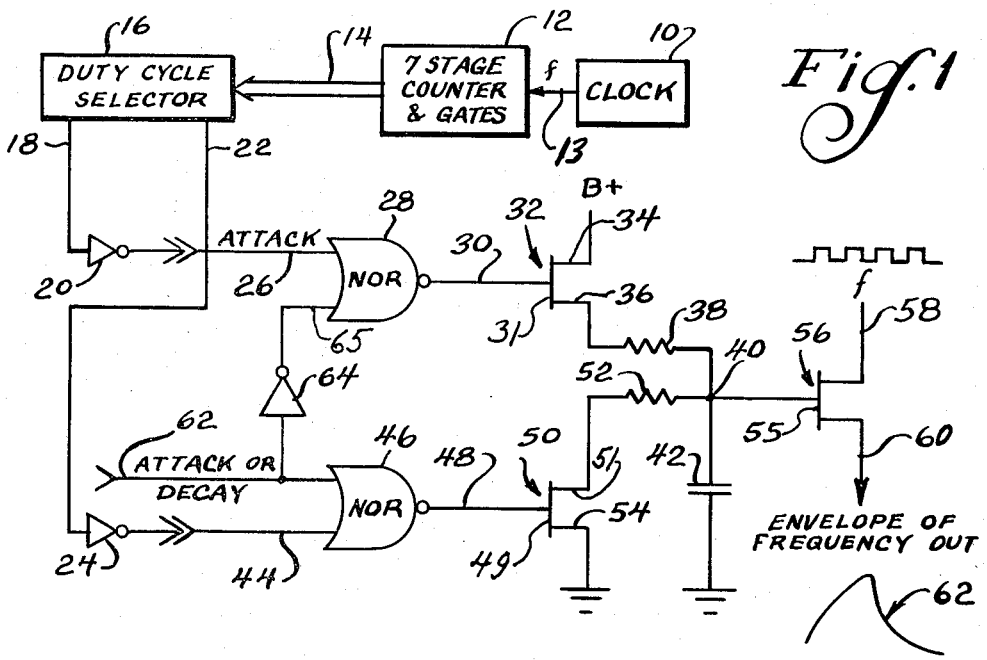
FIG. 1 is a schematic wiring diagram illustrating the invention.

Turning now to FIG. 1 there is shown a digital clock 10 having a 50% duty cycle rectangular wave of frequency f and coupled at 13 to a 7 stage counter and gates 12. This combination produces a series of rectangular waves having duty cycles as follows: 0, $\frac{1}{2}$, $\frac{1}{4}$, $\frac{1}{8}$, 1/16, 1/32, 1/64, 1/128, and 1/256. The outputs 14 are connected to a duty cycle selector 16 having an attack output 18 leading through an inverter 20 to the attack input of the balance of the circuit set forth shortly hereinafter. There is also a decay output 22 from the duty cycle selector 16 leading through an inverter 24 to a decay input 44. As will be understood the duty cycle selector simply comprises selective switch means, which on an organ would be labeled attack or decay to allow the attack output 18 or the decay output 22 to consist of a rectangular wave having any of the duty cycles just noted.

The attack output 18 is connected through inverter 20 to an attack input 26 leading to a NOR gate 28 having an output at 30 connected to the gate 31 of a FET 32. The drain 34 of the FET 32 is connected to B+, while the source 36 is connected to a resistor 38. The resistor is connected to a junction 40 at one plate of an envelope control capacitor 42, the other plate of which is grounded. ("Ground" is used as a convenient term, but it will be understood that some other reference potential could be used as in known integrated circuit technology.)

The decay output 22 is connected through inverter 24 to a decay input 44 of a NOR gate 46 having an output 48 connected to the gate 49 of a FET 50, the drain 51 of which is connected through a resistor 52 to the junction 40. The source 54 is connected to ground. While resistors 38 and 52 are shown as separate elements from FET's 32 and 50 for ease of understanding, in the preferred integrated circuit embodiment of this invention, these resistances arise from the geometry of FET's 32 and 50.

The junction point 40 is connected to the gate 55 of a FET 56 having its drain 58 connected to a means (not shown) for supplying a frequency f corresponding to the note played on the organ or other electronic musical instrument embodying the invention. The frequency is shown as a square wave although it may be any waveform. The source 60 of the FET 56 produces an output which comprises the combination of the input square wave with the envelope 62 as determined by the charge on capacitor 42 applied to gate 55 of the FET 56.

At attack or decay input, which is derived from the keyboard, and which comprises either a 1 or a 0 is applied to an input 62 which comprises the second input of the NOR gate 46. The input also is applied through an inverter 64 to the second input 65 of the NOR gate 28.

When a note is first played a 1 appears on the input 62. Since a 0 is active for the present circuits this disables the NOR gate 46 as to any input on the line 44. However, the 1 is inverted by the inverter 64 and becomes a 0 applied to the second input of the NOR gate 28. Thus, an output 1 will appear on the line 30 whenever an input 0 appears on the line 26. Thus, a constant input 0, a 100% duty cycle, will hold the FET 32 on for rapid charging of the capacitor 42 through the resistor 38. However, when a 50% duty cycle wave, for example is applied, then the FET 32 will only be on half of the time, and the capacitor will charge more slowly. Additional duty cycles of lesser amounts will produce an even slower charge rate.

Conversely, when a key is released a 0 is applied to the input line 62, thus enabling the NOR gate 46 and, as a result of being inverted by inverter 64, shutting off the NOR gate 28. The duty cycle of the wave applied from 22 to 44 into the NOR gate 46 will thus determine the on time of the FET 50, and hence the rapidity of discharge of the capacitor 42.

The output wave shown in 62 in FIG. 1 is simply exemplary, and almost any sort of envelope can be produced. A typical example would be a rather rapid attack and a slow decay. The fastest attack would be provided with a 1 output from the duty cycle selector 16 on the attack line 18, i.e., the first of the possible duty cycles out, which produce a 0 on attack line 26. Conversely, a 1/256 duty cycle on the decay would produce a very long decay, on the order of seconds, i.e,.

Figure 2:
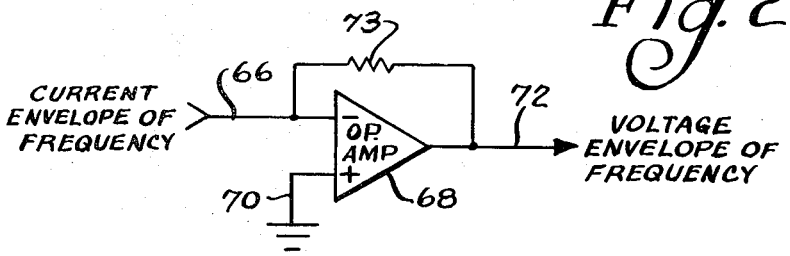
FIG. 2 is another schematic wiring diagram of an ensuing stage.

The FET 56 acts as a linear resistor, operating in a current starving mode. In order to change the current output to voltage output the source 60 of the FET 56 is connected to the input 66 (FIG. 2) of an operational amplifier (OP AMP) 68, the other input 70 being grounded. The OP AMP has an output at 72 returned to the input through a resistor 73 thus serving as a low input impedance operational amplifier, which changes current to voltage. A simple resistor or a resistor with a transistor gain stage will accomplish nearly the same function. It is important that the impedance be low to minimize intermodulation distortion.

Figure 3:
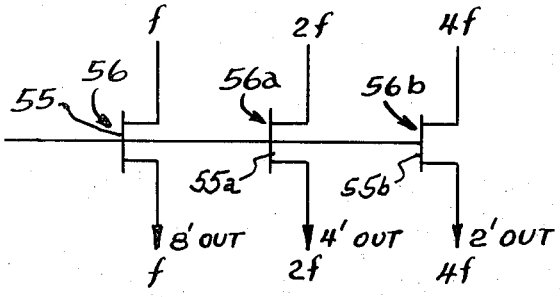
FIG. 3 is a fragmentary schematic wiring diagram showing application of the principles of the invention simultaneously to a plurality of footages of an organ.

With reference to FIG. 3, the output from the junction 40, is connected not only to the gate 55 of the FET 56 to provide an envelope for the frequency f, but also is connected to the gate **55*a* of FET 56*a* controlling an input frequency 2f, and also to the gate 55*b* of a FET 56*b*** controlling a frequency input 4f, thus to provide an 8 foot frequency out, a 4 foot frequency out, and a 2 foot frequency out upon operation of a single key switch. As will be appreciated, more than three footages could be combined, and it would be common to provide also a 16 foot footage.

Figure 4:
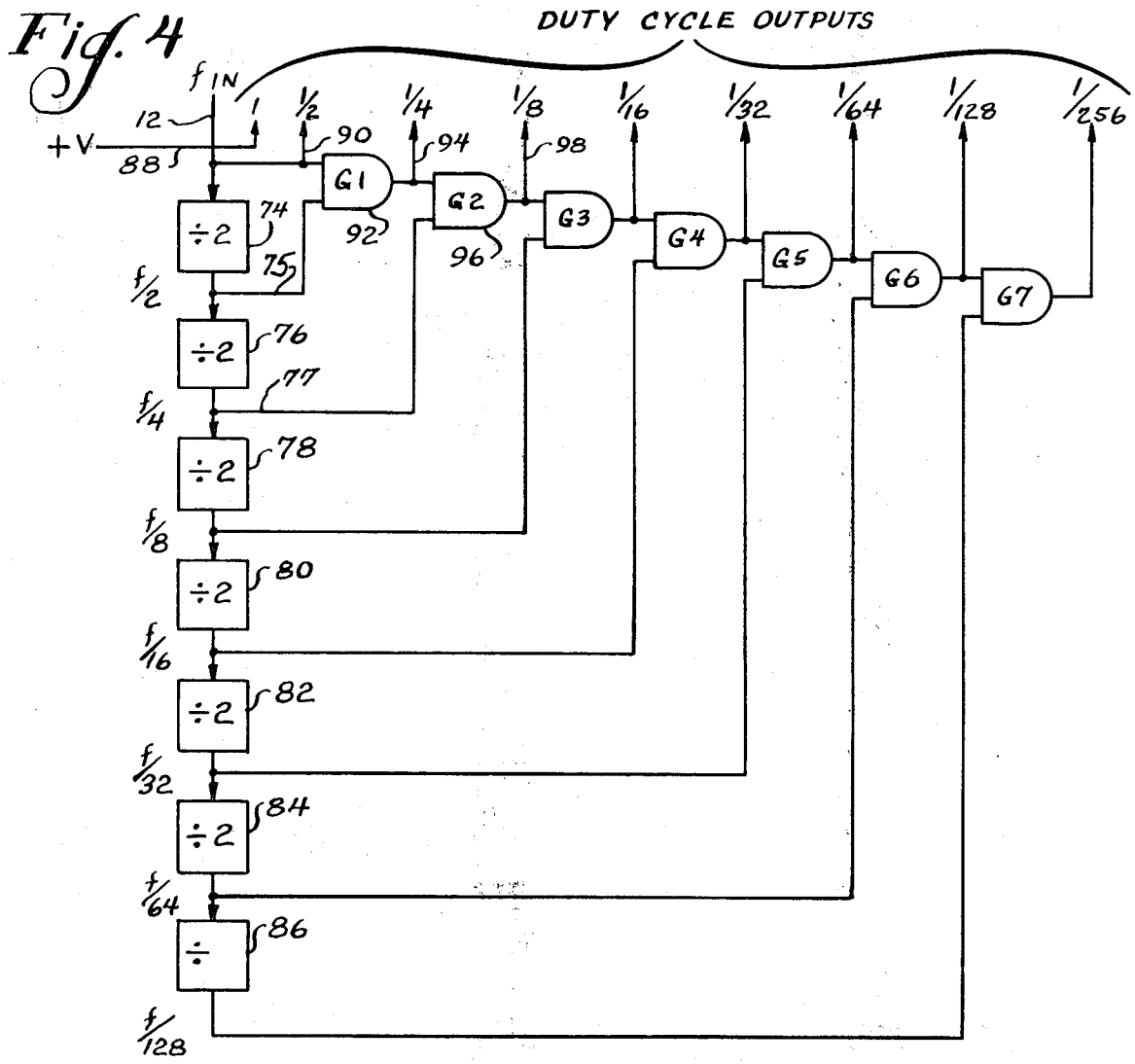
FIG. 4 is a wiring diagram of the counter and duty cycle outputs.

An exemplification of the 7 stage counter and gates 12 is shown in FIG. 4. The frequency $f_{in}$ at 12 is connected serially to 7 successive divide-by-two stages 74, 76, 78, 80, 82, 84 and 86. The 100% duty cycle is provided by a connection 88 to a plus voltage source +V, while the 50% duty cycle is provided at 90 by the input frequency f. The input frequency f is added with the signal at output 75 of the first divide stage 74 in a first AND gate 92. The output signal of gate 92 comprises a 25% duty cycle wave at output 94.

The output signal at 94 and the output signal of the second divider 76 at output 77 are added in a second AND gate 96 to provide a ⅛ duty cycle wave out at output 98. A similar addition of signals continues as will be apparent from FIG. 4 in the remaining gates G3–G7.

Figure 5:
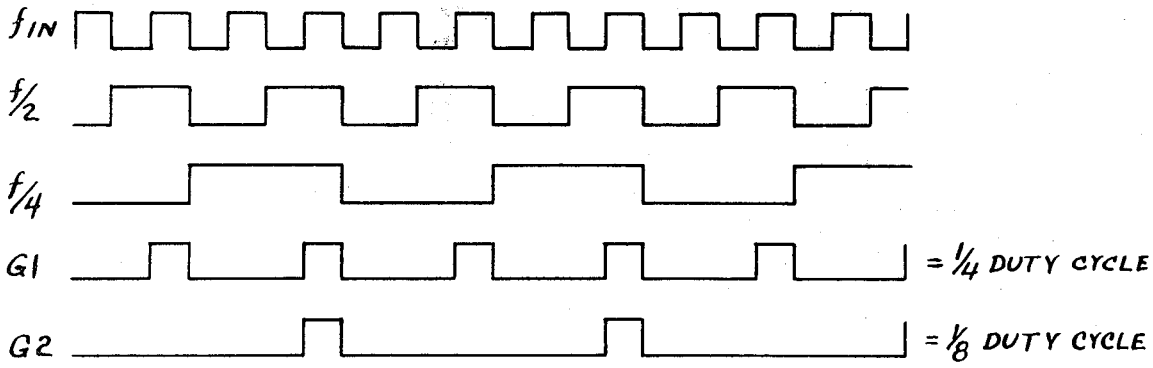
FIG. 5 is a wave diagram illustrating the operation of the circuits of FIG. 4.

The wave addition is shown in FIG. 5. The input frequency is shown on the top line as $f_{in}$. The second line shows f/2, the output of the first divider, while the second line shows f/4, the output of the second divider.

The fourth line illustrates addition of $f_{in}$ and f2 in the first gate, there being a 1 output whenever the 1's of $f_{in}$ and f/2 coincide. The result is the ¼ duty cycle rectangular wave at output 94.

On line five the addition of the foregoing ¼ duty cycle wave and f/4 in the second gate 96 or G2 is shown to be the desired ⅛ duty cycle wave at output 98. The remaining additions are similar and do not require specific illustration.

NAND gates could be used in FIG. 4 with appropriate phasing to avoid use of the inverters 20 and 24 in FIG. 1.

As will be apparent, important features of the present invention include the use of digital waves for the control of attack and decay. The entire circuits as heretofore shown and described are mostly susceptible to incorporation in large scale integrated circuits. Indeed, the lower portion of FIG. 1 plus FIG. 2, FIG. 3 if desired, and also FIG. 4 could comprise only a portion of a single large scale integrated circuit chip. Such a chip would typically be fabricated in insulated gate FET technology through the use of well-known diffusion and oxidation steps on a silicon substrate to produce a conventional integrated circuit structure. Being able to produce this circuitry in a common substrate has important cost and reliability advantages over the use of conventional analog techniques heretofore employed in organ circuits, which require the use of either discrete components or a multiplicity of integrated circuit chips to provide the same circuit functions.

The specific examples of the invention as herein set forth are by way of illustration only. Various changes will no doubt occur to those skilled in the art and will be understood as forming a part of the present invention insofar as they fall within the spirit and scope of the appended claims.

The invention is claimed as follows:

1. In an electronic musical instrument, the combination for effecting digital control of attack and decay comprising means for storing electrical energy, a source of substantially constant direct current potential for supplying energy to said energy storing means, first controllable switch means connected between said source and said energy storing means and having a control element means for supplying a first digital wave of controlled duty cycle and having an amplitude independent of said direct potential, a clock duty cycle means connected to said clock including a counter and a plurality of gates providing a plurality of outputs of different duty cycles, player controlled means connected to said duty cycle means for selecting a desired duty cycle for said first digital wave, means for selectively connecting said first digital wave to said control element at said selected duty cycle to control the rate at which energy is supplied to said storing means, second controllable switch means connecting between said storing means and a reference potential and having an amplitude independent of said direct current potential, further player controlled means connected to said duty cycle means for selecting a desired duty cycle for said second digital wave, means for selectively connecting said second digital wave to the control element of said second controllable switch means at said selected duty cycle to control the rate at which said storage means discharges, means providing an electrical wave corresponding to a desired musical tone, and a third controllable switch means to which said musical tone electrical wave providing means is connected, said third controllable switch means having a control element to which said electrical energy storing means is connected for controlling the passage of said musical tone electrical wave through said controllable switch means to determine attack and decay of said wave.

2. The combination as set forth in claim 1 wherein each controllable switch means is a field effect transistor on a common substrate.

3. The combination as set forth in claim 1 wherein each means for selectively connecting the digital waves of controlled duty cycle to the control elements comprises a digital gate having two input connections, said gates each having one input respectively connected to one of said digital waves, and further including a common line for attack or decay connected directly to the second input of one of said gates and through an inverter to the second input of the other of said gates for rendering one gate nonconductive when the other gate is conductive.

* * * * *

UNITED STATES PATENT AND TRADEMARK OFFICE

CERTIFICATE OF CORRECTION

PATENT NO. : 4,253,369

DATED : March 3, 1981

INVENTOR(S) : WILLIAM R. HOSKINSON

It is certified that error appears in the above-identified patent and that said Letters Patent are hereby corrected as shown below:

Column 4, line 45, after "direct" insert --current--.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*